US010444678B2

(12) United States Patent
Miyazaki

(10) Patent No.: US 10,444,678 B2
(45) Date of Patent: Oct. 15, 2019

(54) FIXING DEVICE AND IMAGE FORMING APPARATUS

(71) Applicant: FUJI XEROX CO., LTD., Tokyo (JP)

(72) Inventor: Akio Miyazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/116,933

(22) Filed: Aug. 30, 2018

(65) Prior Publication Data

US 2019/0212678 A1 Jul. 11, 2019

(30) Foreign Application Priority Data

Jan. 10, 2018 (JP) ..... 2018-001863

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2007/0122173 A1* 5/2007 Mitsuoka ..... G03G 15/2039 399/69
2014/0133880 A1* 5/2014 Otsuka ..... G03G 15/2039 399/70
2018/0348680 A1* 12/2018 Fujimoto ..... G03G 15/2042

FOREIGN PATENT DOCUMENTS

JP 2004-258151 9/2004

* cited by examiner

*Primary Examiner* — Sandra Brase
(74) *Attorney, Agent, or Firm* — JCIPRNET

(57) ABSTRACT

A fixing device includes a fixing unit having heat sources each extending in a longitudinal direction thereinside, and sensors that measure a surface temperature of the fixing unit. The heat sources are provided at different positions in a projection diagram of the fixing device seen in a rotational-axis direction of the fixing unit. A first measurement position for a first sensor is different in the peripheral direction from a second measurement position for a second sensor. A sum of a first distance between the first measurement position and a first heat source nearest to the first measurement position and a second distance between the second measurement position and a second heat source nearest to the second measurement position is smaller than a sum of the first and second distances in a case where the second measurement position coincides with the first measurement position in the peripheral direction.

10 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2018-001863 filed Jan. 10, 2018.

BACKGROUND (i) Technical Field

The present invention relates to a fixing device and an image forming apparatus.

(ii) Related Art

To control the temperature of a fixing roller (a fixing unit) including a heat source thereinside, a fixing device includes a temperature sensor for measuring the surface temperature of the fixing unit.

SUMMARY

According to an aspect of the invention, there is provided a fixing device including a fixing unit that rotates in a peripheral direction and in which a plurality of heat sources each extending in a longitudinal direction are provided, and a plurality of sensors that measure a surface temperature of the fixing unit. The plurality of heat sources are provided at different positions in a projection diagram in which the fixing device is projected in a rotational-axis direction of the fixing unit. A first measurement position on the surface of the fixing unit that is defined for a first one of the plurality of sensors is different in the peripheral direction from a second measurement position on the surface of the fixing unit that is defined for a second one of the plurality of sensors. A sum of a first distance between the first measurement position and a first one of the plurality of heat sources that is nearest to the first measurement position in the projection diagram and a second distance between the second measurement position and a second one of the plurality of heat sources that is nearest to the second measurement position in the projection diagram is smaller than a sum of the first distance and the second distance in a case where the second measurement position coincides with the first measurement position in the peripheral direction.

BRIEF DESCRIPTION OF THE DRAWINGS

An exemplary embodiment of the present invention will be described in detail based on the following figures, wherein.

DETAILED DESCRIPTION

Figure 1:
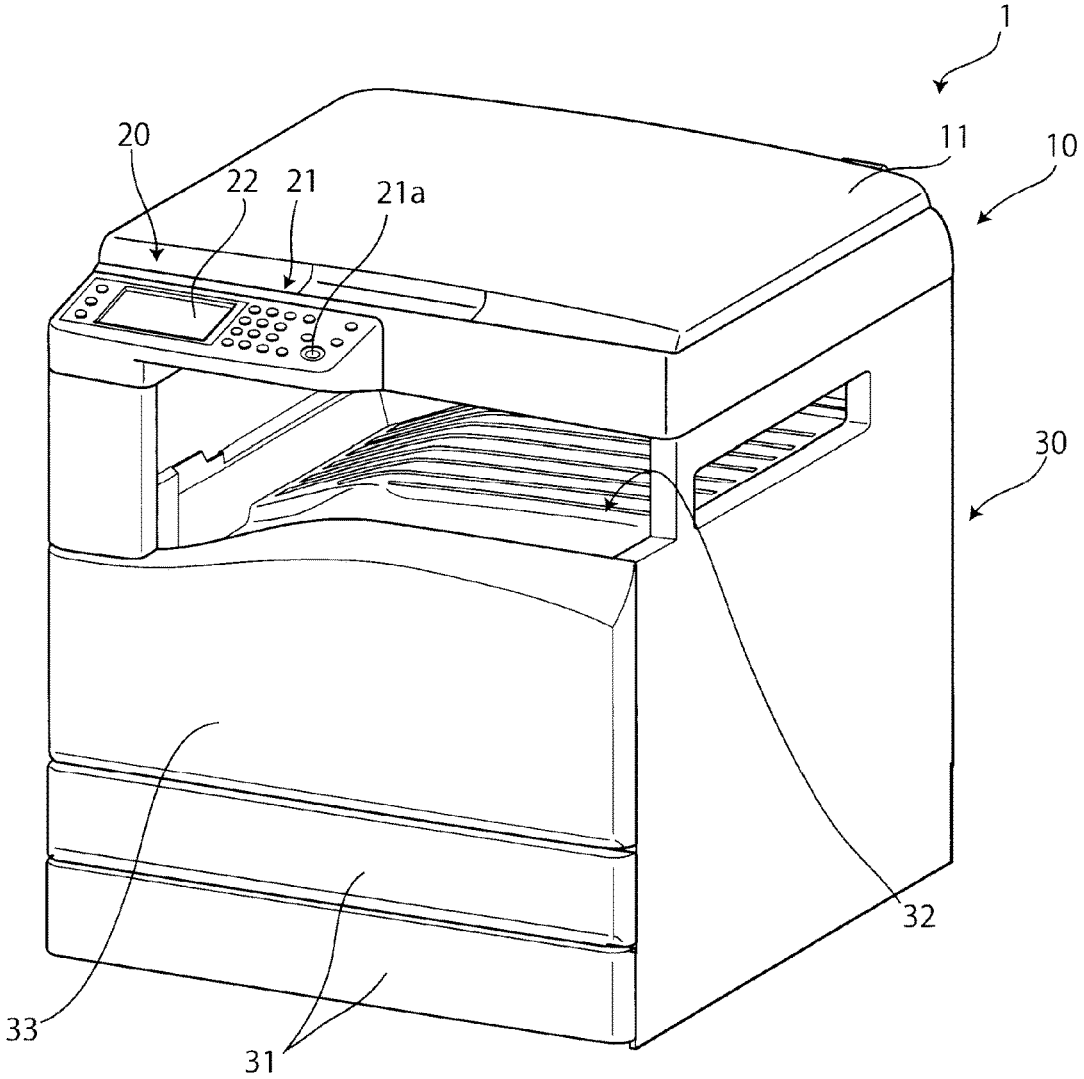
FIG. 1 is an external perspective view of a printer as an image forming apparatus according to an exemplary embodiment of the present invention.

FIG. 1 is an external perspective view of a printer as an image forming apparatus according to an exemplary embodiment of the present invention.

A printer 1 includes at the top thereof an image reading unit 10 that reads an image from a document. The image reading unit 10 is provided with a lid 11. The lid 11 is openable and closable by rotating on a hinge provided on the rear side thereof. The lid 11 is opened, a document is set face down thereon, the lid 11 is closed, and a start button 21*a* is pressed, whereby an image on the document is read, and image data is generated.

The printer 1 includes a user interface 20. The user interface 20 has plural operation buttons 21, including the start button 21*a*, and a display screen 22.

The printer 1 further includes an image forming unit 30 that forms an image on a sheet with toners on the basis of the image data.

The printer 1 further includes two drawable sheet trays 31 at the bottom of the image forming unit 30. The sheet trays 31 each contain a stack of sheets to be used for image formation. In the image forming unit 30, one of the sheets is picked up from a designated one of the sheet trays 31, and an image is formed on that sheet. The sheet having an image formed thereon is outputted onto a sheet output tray 32 provided at the top of the image forming unit 30.

The image forming unit 30 is provided, above the sheet trays 31, with a front covering 33 that is openable and closable. The front covering 33 is opened when any of toner cartridges 59Y, 59M, 59C, and 59K (see FIG. 2) is to be exchanged or when a sheet jam occurs, so that an appropriate treatment is performed.

The image forming unit 30 forms an image on the basis of not only the image data that is read by the image reading unit 10, but also image data received from an external device such as a computer for image editing.

Figure 2:
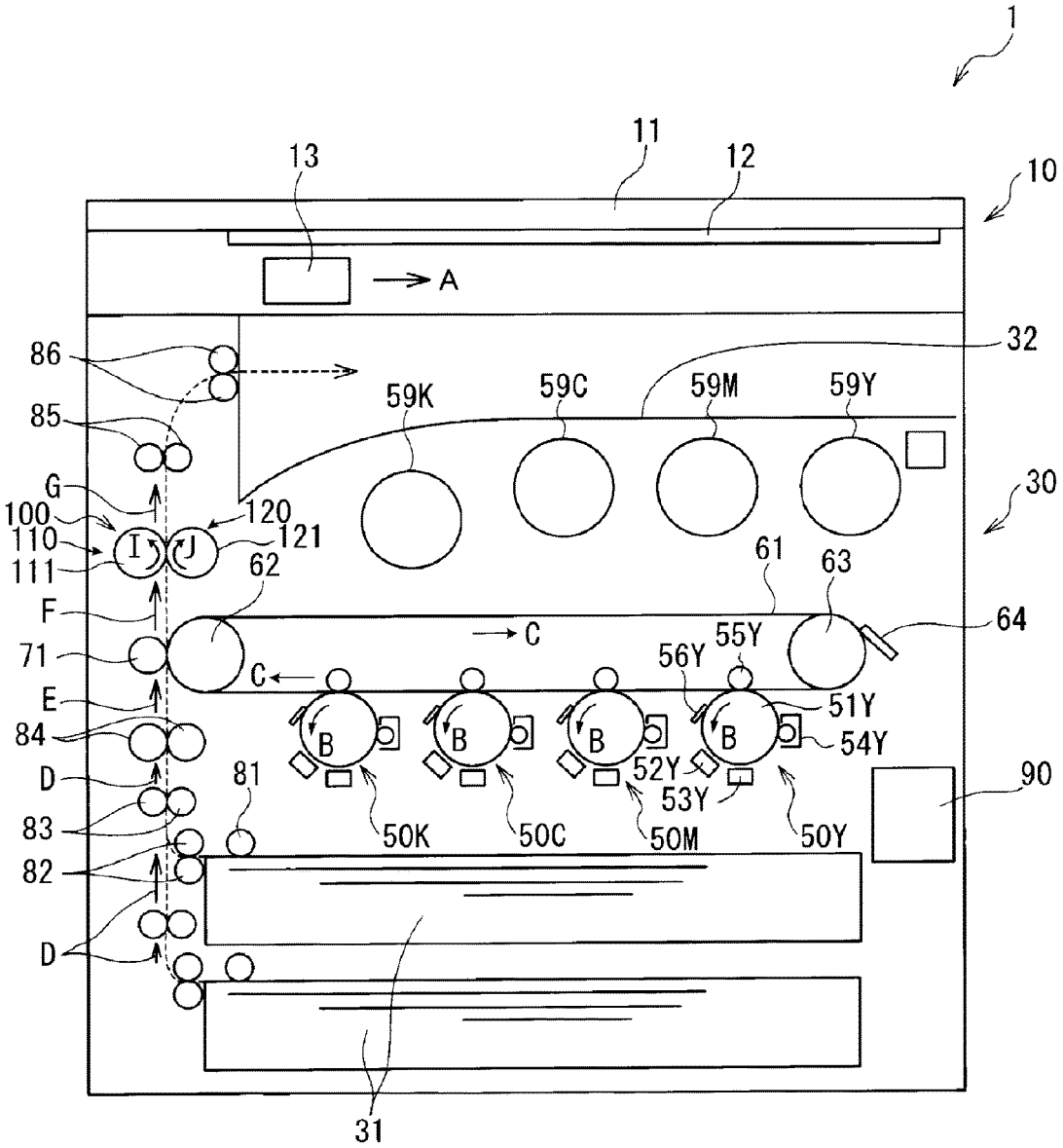
FIG. 2 is a schematic diagram illustrating an outline internal configuration of the printer illustrated in FIG. 1.

FIG. 2 is a schematic diagram illustrating an outline internal configuration of the printer 1 illustrated in FIG. 1.

The printer 1 includes a transparent glass plate 12 immediately below the lid 11 of the image reading unit 10 provided at the top thereof. After the lid 11 is opened, a document to be read is laid face down on the glass plate 12. The printer 1 includes an image reading sensor 13 below the glass plate 12. The image reading sensor 13 reads the image on the document. The image reading sensor 13 extends in the depth direction of the printer 1 (in a direction perpendicular to the plane of FIG. 2) and sequentially reads the image on the document while moving in a direction of arrow A, thereby generating image data.

The image forming unit 30 includes four image forming engines 50Y, 50M, 50C, and 50K provided above the sheet trays 31 and arranged side by side horizontally. The image forming engines 50Y, 50M, 50C, and 50K form respective toner images with toners having respective colors of yellow (Y), magenta (M), cyan (C), and black (K). The image forming engines 50Y, 50M, 50C, and 50K all have the same configuration, except that the colors of the toners to be used are different. Hereinafter, if there is no need to distinguish relevant elements from one another by their colors, those elements are denoted without the suffixes Y, M, C, and K representing the colors thereof but only with the reference numeral.

The image forming engines 50 each include a photoconductor drum 51 that rotates in a direction of arrow B. The image forming engine 50 further includes a charging device 52, an exposure device 53, a developing device 54, a first transfer device 55, and a cleaner 56 that are arranged around the photoconductor drum 51.

The charging device 52 uniformly charges the surface of the photoconductor drum 51.

The exposure device 53 applies exposure light modulated in accordance with the image data to the photoconductor drum 51, thereby forming an electrostatic latent image on the surface of the photoconductor drum 51.

The developing device 54 contains the toner having the color (Y, M, C, or K) of a corresponding one of the image forming engines 50Y, 50M, 50C, and 50K. The developing device 54 develops the electrostatic latent image on the photoconductor drum 51 with the toner contained therein, thereby forming a toner image on the photoconductor drum 51.

The image forming unit 30 includes an intermediate transfer belt 61 above the four image forming engines 50Y, 50M, 50C, and 50K that are arranged side by side horizontally. The intermediate transfer belt 61 is an endless belt and is stretched between rollers 62 and 63. The intermediate transfer belt 61 rotates in a direction of arrow C along the four image forming engines 50Y, 50M, 50C, and 50K.

The image forming unit 30 includes the four toner cartridges 59Y, 59M, 59C, and 59K above the intermediate transfer belt 61. The toner cartridges 59Y, 59M, 59C, and 59K contain the toners having the respective colors (Y, M, C, and K). When the amount of toner in the developing device 54 included in any of the image forming engines 50 becomes short, the toner in a corresponding one of the toner cartridges 59 is supplied to that developing device 54.

The first transfer device 55 included in each of the image forming engines 50 is positioned on the inner side of the intermediate transfer belt 61 such that the intermediate transfer belt 61 is nipped between the first transfer device 55 and the photoconductor drum 51. The first transfer device 55 acts on the toner image formed on the photoconductor drum 51 and transfers the toner image to the intermediate transfer belt 61. Four toner images thus formed by the respective image forming engines 50Y, 50M, 50C, and 50K are sequentially transferred to the intermediate transfer belt 61 one on top of another with the rotation of the intermediate transfer belt 61.

The cleaner 56 removes unnecessary toner particles, remaining on the photoconductor drum 51 after the transfer, from the photoconductor drum 51, thereby cleaning the photoconductor drum 51.

The toner images transferred to the intermediate transfer belt 61 one on top of another are transported by the intermediate transfer belt 61 and is transferred to a sheet by a second transfer device 71 acting thereon. Unnecessary toner particles remaining on the intermediate transfer belt 61 after the image transfer to the sheet are removed from the intermediate transfer belt 61 by a cleaner 64.

The sheets contained in the sheet trays 31 are picked up one by one by a pickup roller 81. If plural sheets are picked up at a time, one of the sheets is assuredly separated from the others by separating rollers 82 and is transported in a direction of arrow D to timing adjusting rollers 84 by transport rollers 83.

The sheet is further fed in a direction of arrow E by the timing adjusting rollers 84 at a timing adjusted such that the sheet reaches the second transfer device 71 at a timing at which the toner images transferred to the intermediate transfer belt 61 reach the second transfer device 71. Then, the second transfer device 71 acts on the toner images, thereby transferring the toner images from the intermediate transfer belt 61 to the sheet.

The sheet thus having the toner images is further transported in a direction of arrow F and passes through a fixing device 100. The fixing device 100 includes a pressing device 110 having a pressing roller 111 that rotates in a direction of arrow I, and a heating device 120 having a heating roller 121 rotating in a direction of arrow J. The heating roller 121 is an example of the fixing unit according to the present invention.

The sheet transported to the fixing device 100 receives pressure and heat by being nipped between the pressing roller 111 and the heating roller 121, whereby the toner images on the sheet is fixed.

The sheet passed through the fixing device 100 is transported in a direction of arrow G by transport rollers 85 and is outputted by sheet outputting rollers 86 onto the sheet output tray 32 at the top of the image forming unit 30.

The printer 1 includes a controller 90. The controller 90 is responsible for controlling relevant elements of the printer 1, including transmission and reception of image data, an operation of controlling the temperature of the heating roller 121, and other like operations.

Now, the background of the present invention will be described.

Figure 3A:
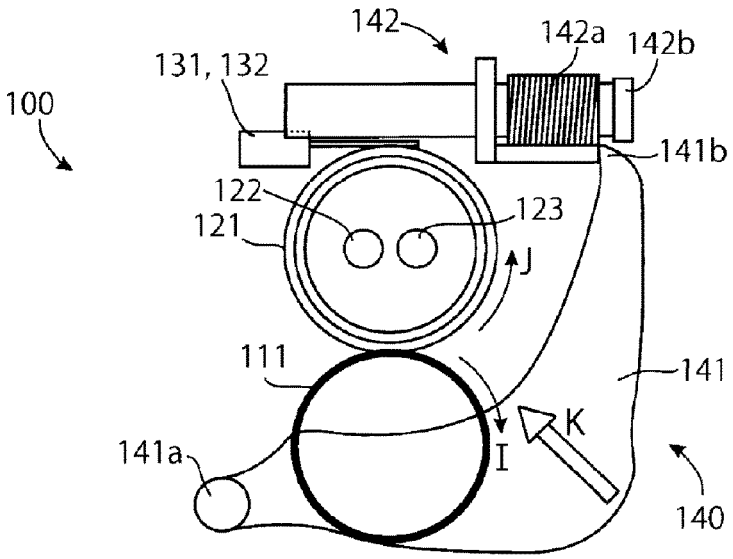
FIG. 3A RELATED ART
FIGS. 3A and 3B are schematic diagrams illustrating an exemplary related-art fixing device.
Figure 3B:
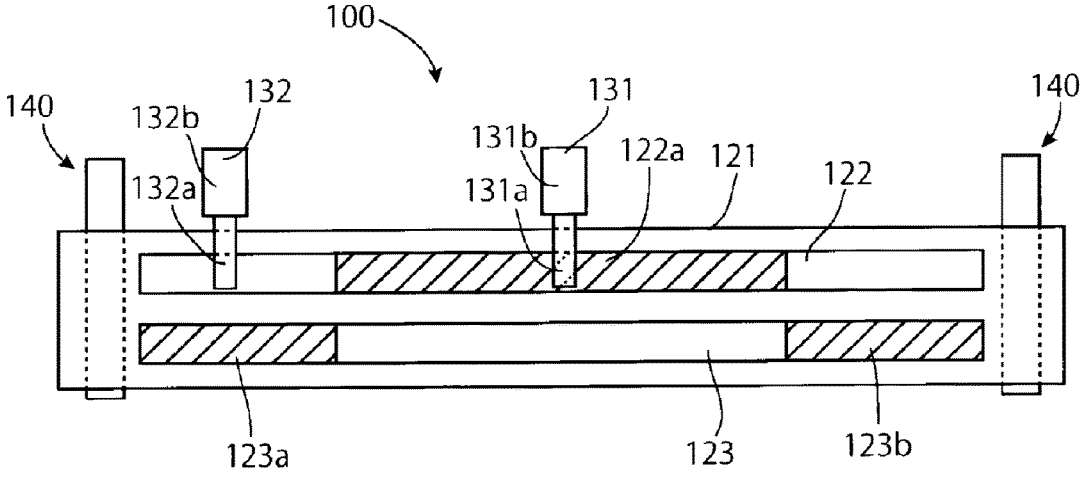
FIG. 3B RELATED ART

FIGS. 3A and 3B are schematic diagrams illustrating an exemplary related-art fixing device. FIG. 3A is a projection diagram in which the fixing device is projected in a rotational-axis direction thereof. FIG. 3B is a schematic diagram illustrating the shape of the fixing device oriented with the rotational axis thereof extending horizontally.

While the pressing roller 111 and the heating roller 121 illustrated in FIG. 2 are arranged side by side horizontally, a pressing roller 111 and a heating roller 121 illustrated in FIG. 3A are stacked vertically.

The heating roller 121 includes thereinside two heat sources 122 and 123 each extending in a longitudinal direction, i.e., the rotational-axis direction, thereof. In the projection diagram illustrated in FIG. 3A in which the fixing device 100 is projected in the rotational-axis direction thereof, the two heat sources 122 and 123 are at different positions in the heating roller 121. The two heat sources 122 and 123 are responsible for heating the heating roller 121 from the inside under the control of the controller 90 illustrated in FIG. 2. One of the two heat sources 122 and 123, specifically, the heat source 122, includes a heater (not illustrated) in a central portion thereof that is hatched in FIG. 3B. When the heater generates heat, the central portion serves as a heating portion 122*a* that heats the heating roller 121. The other heat source 123 includes heaters (not illustrated) in two respective end portions thereof that are hatched in FIG. 3B. When the heaters generate heat, the two end portions serve as heating portions 123*a* and 123*b*, respectively, that heat the heating roller 121. The heat source 122 having the heating portion 122*a* in the central portion thereof and the heat source 123 having the heating portions 123*a* and 123*b* at the two respective end portions thereof, i.e., a total of two heat sources 122 and 123, are provided because the way the temperature rises or drops is different between the central portion and the end portions of the heating roller 121, and the temperature in the central portion and the temperature in the end portions therefore need to be controlled individually.

The fixing device 100 further includes two temperature sensors 131 and 132. The temperature sensor 131, i.e., one of the two temperature sensors 131 and 132, measures the temperature of the central portion, in the longitudinal direction, of the outer peripheral surface of the heating roller 121. The temperature sensor 131 is of a contact type and includes a detecting portion 131*a* that is in contact with the outer peripheral surface of the heating roller 121 and detects the temperature at that point of contact, and a supporting portion 131*b* that supports the detecting portion 131*a*.

The other temperature sensor 132 measures the temperature of one of the two end portions, in the longitudinal direction, of the outer peripheral surface of the heating roller 121. The heating roller 121 has a substantially symmetrical temperature distribution in the longitudinal direction thereof. Therefore, the temperature sensor 132 measures the temperature of one of the two end portions. The temperature sensor 132 is also of a contact type and includes a detecting portion 132*a* that is in contact with the outer peripheral surface of the heating roller 121 and detects the temperature at that point of contact, and a supporting portion 132*b* that supports the detecting portion 132*a*.

The results of temperature measurements obtained by the temperature sensors 131 and 132 are inputted to the controller 90 illustrated in FIG. 2. The controller 90 electrifies the heat sources 122 and 123 on the basis of the results of temperature measurements inputted thereto, and controls the temperature and the temperature distribution of the heating roller 121.

The fixing device 100 further includes pressing mechanisms 140 at the two respective ends thereof in the longitudinal direction. The pressing mechanisms 140 press the pressing roller 111 against the heating roller 121. The pressing mechanisms 140 each include a pressing lever 141 and a pressure adjusting member 142.

The pressing lever 141 is rotatable on a support 141*a* and is connected at a tip portion 141*b* thereof to the pressure adjusting member 142. The pressure adjusting member 142 includes a coil spring 142*a* and a screw 142*b*. When the amount of compression of the coil spring 142*a* is adjusted with the screw 142B, the pressing lever 141 presses the pressing roller 111 in a direction of arrow K with a pressing force corresponding to the amount of adjustment. Thus, the pressing roller 111 is pressed against the heating roller 121.

The two ends of each of the pressing roller 111 and the heating roller 121 on which the pressing mechanisms 140 are provided, respectively, are positioned outside a sheet passing area of the fixing device 100 where the sheet passes. Hence, to reduce the size of the fixing device 100, the position of each of the pressing mechanisms 140 may be shifted a little inward in the longitudinal direction.

Figure 4A:
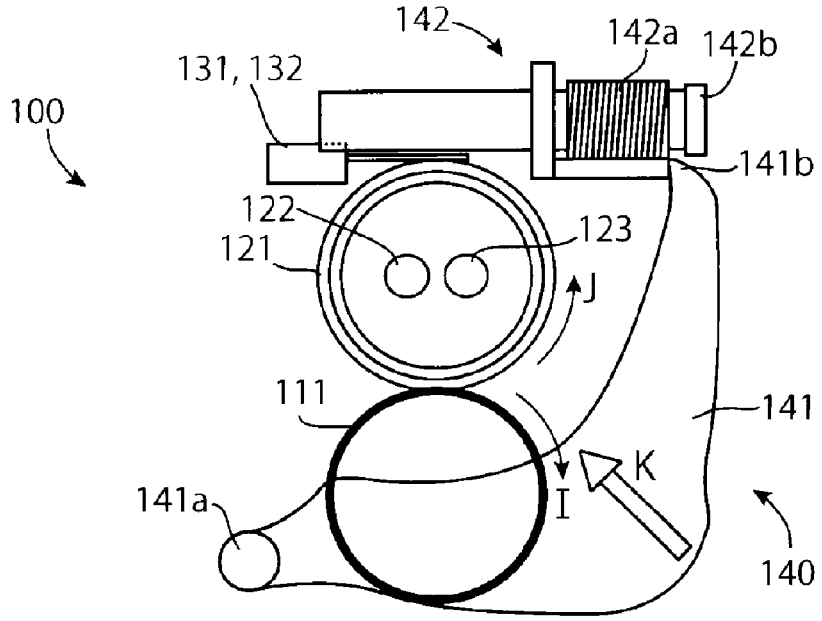
FIG. 4A RELATED ART
FIGS. 4A and 4B are schematic diagrams of the fixing device, with pressing mechanisms thereof being shifted inward.
Figure 4B:
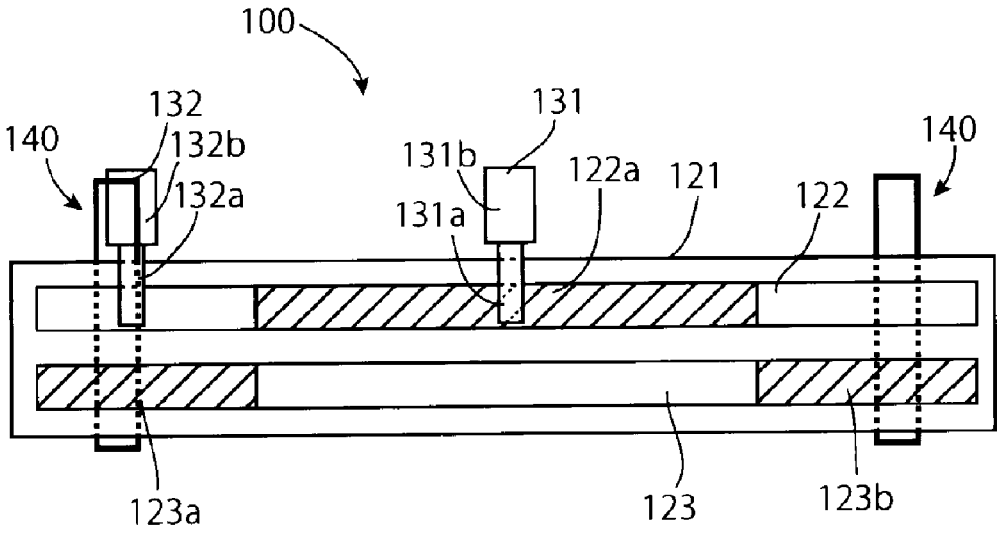
FIG. 4B RELATED ART

FIGS. 4A and 4B are schematic diagrams of the fixing device 100, with the pressing mechanisms 140 thereof being shifted inward. FIG. 4A is the same as FIG. 3A. FIG. 4B illustrates the state where the pressing mechanisms 140 are shifted inward from the positions thereof illustrated in FIG. 3B.

As the pressing mechanisms 140 are shifted inward, one of the pressing mechanisms 140 interferes with the temperature sensor 132 provided nearby. In such a state, the pressing mechanism 140 is not allowed to be shifted up to the inward position illustrated in FIG. 4B.

The present invention has been conceived in view of the above circumstances, with consideration for the positions of temperature sensors. Hereinafter, specific examples according to the exemplary embodiment of the present invention in which the positions of temperature sensors are determined carefully will be described.

Figure 5A:
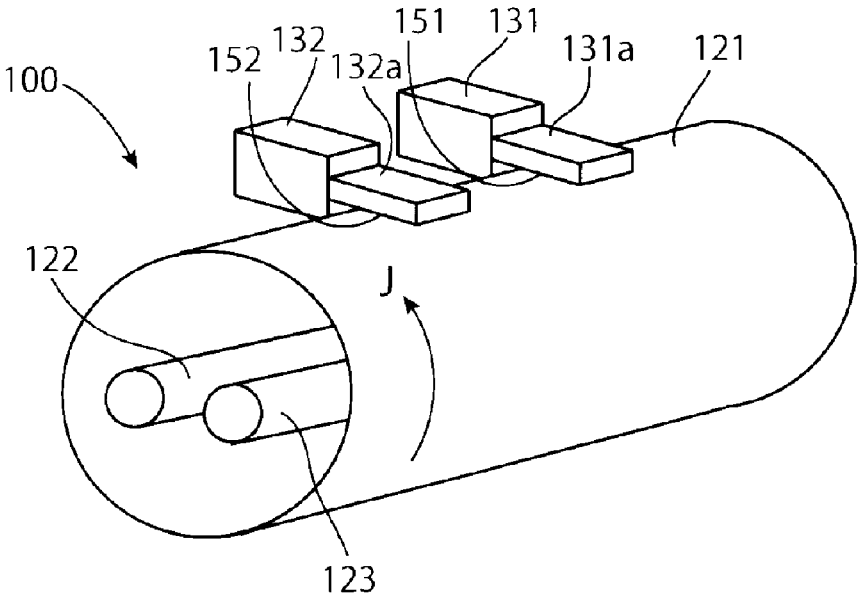
FIG. 5A RELATED ART
FIGS. 5A and 5B are schematic diagrams illustrating an arrangement of temperature sensors included in the related-art fixing device illustrated in FIGS. 3A and 3B.
Figure 5B:
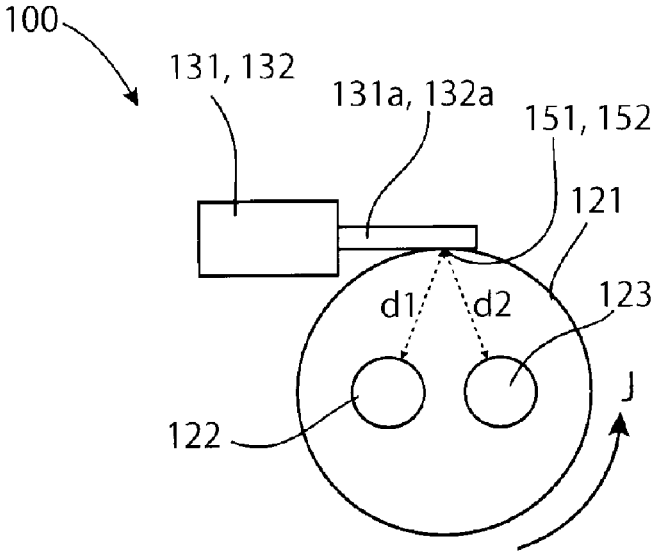
FIG. 5B RELATED ART

FIGS. 5A and 5B are schematic diagrams illustrating an arrangement of the temperature sensors 131 and 132 included in the related-art fixing device illustrated in FIGS. 3A and 3B, not the fixing device according to the exemplary embodiment of the present invention. That is, FIGS. 5A and 5B illustrate a comparative example to the present invention. In the drawings to be referred to below, although the pressing roller 111 and the pressing mechanisms 140 are not illustrated, the whole set of elements illustrated therein is denoted as "fixing device 100" as a matter of convenience.

FIG. 5A is a perspective view of a fixing device 100. FIG. 5B is a projection diagram of the fixing device 100 projected in the longitudinal direction thereof.

In FIGS. 5A and 5B, a heating roller 121, two heat sources 122 and 123, and two temperature sensors 131 and 132 are illustrated as elements of the fixing device 100. Although simplified in FIGS. 5A and 5B, the two heat sources 122 and 123 illustrated in FIG. 5A correspond to the two heat sources 122 and 123, respectively, illustrated in FIGS. 3A and 3B, and the two temperature sensors 131 and 132 illustrated in FIG. 5A correspond to the temperature sensors 131 and 132, respectively, illustrated in FIGS. 3A and 3B.

Here, the relationship between temperature measurement positions 151 and 152 defined for the temperature sensors 131 and 132 on the outer peripheral surface of the heating roller 121 and the positions of the heat sources 122 and 123 will be considered. The temperature sensors 131 and 132 according to this comparative example are of a contact type. Therefore, the temperature measurement positions 151 and 152 on the outer peripheral surface of the heating roller 121 are each the point of contact between the peripheral surface of the heating roller 121 and a corresponding one of the detecting portions 131*a* and 131*b* of the temperature sensors 131 and 132. The positional relationship in the longitudinal direction of the heating roller 121 will be considered separately below. The positional relationship in the peripheral direction, represented by arrow J, of the heating roller 121 will now be described.

A distance between the temperature measurement position 151 for the temperature sensor 131 and the heat source 122 is denoted by d1, and a distance between the temperature measurement position 152 for the temperature sensor 132 and the heat source 123 is denoted by d2.

For example, a situation where the heat sources 122 and 123 start to be electrified and the temperature of the heating roller 121 that is at room temperature is gradually raised will be considered. In such a situation, the shorter the distances d1 and d2 between the temperature measurement positions 151 and 152 and the respective heat sources 122 and 123, the higher the responsiveness in the temperature measurement with the temperature sensors 131 and 132. In contrast, the longer the distances d1 and d2, the lower the responsiveness in the temperature measurement with the temperature sensors 131 and 132. Such a tendency is pronounced when the heating roller 121 is not rotating.

In view of the above circumstances described with reference to FIGS. 3A to 4B, the temperature measurement positions 151 and 152 are changed to positions where the responsiveness of the temperature sensors 131 and 132 becomes higher than in the related-art example (the comparative example) illustrated in FIGS. 5A and 5B. Comprehensively speaking, temperature measurement positions according to the present exemplary embodiment are set such that a temperature measurement position (a first measurement position) on the outer peripheral surface of the heating roller 121 (a fixing roller) that is defined for a first one of plural sensors is different in the peripheral direction from a temperature measurement position (a second measurement position) on the outer peripheral surface of the heating roller 121 that is defined for a second one of the plural sensors, and the sum of a first distance between the first measurement position and a first one of plural heat sources that is nearest to the first measurement position in a projection diagram in which the fixing device 100 is projected in the rotational-axis direction of the heating roller 121 and a second distance between the second measurement position and a second one of the plural heat sources that is nearest to the second measurement position in the projection diagram becomes smaller than the sum of the first distance and the second distance in a case where the second measurement position coincides with the first measurement position in the peripheral direction.

Figure 6A:
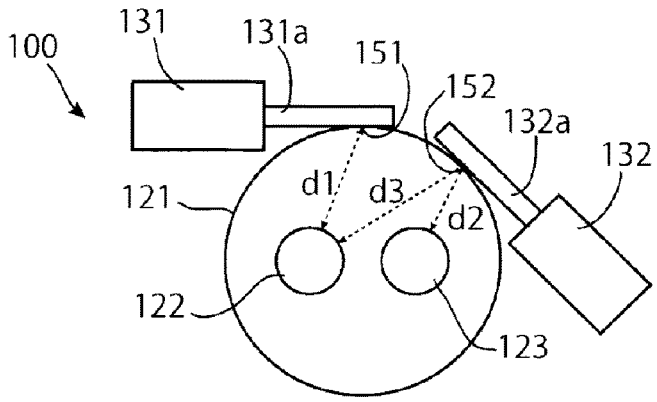
FIGS. 6A to 6C are projection diagrams of fixing devices according to specific examples, respectively, of the exemplary embodiment of the present invention that are projected in a rotational-axis direction of respective heating rollers, and illustrate the arrangement of temperature sensors.
Figure 6B:
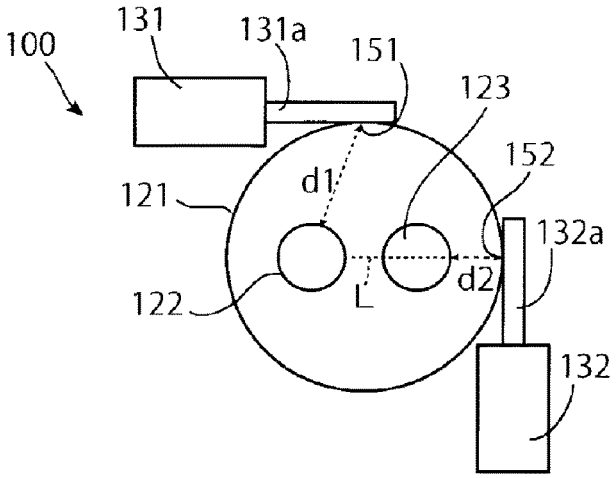
Figure 6C:
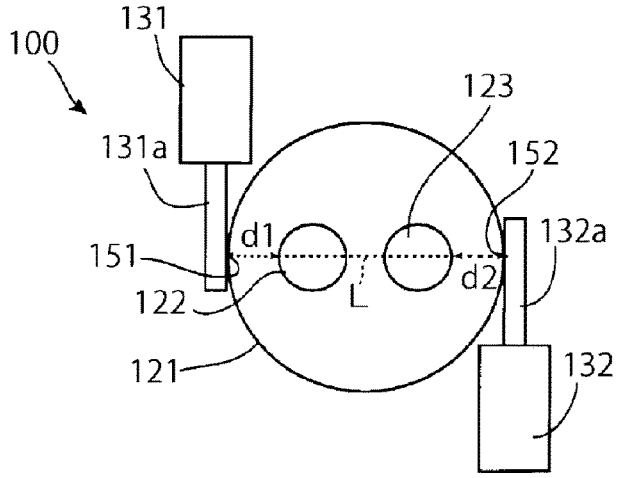

FIGS. 6A, 6B, and 6C are projection diagrams of fixing devices according to first, second, and third specific examples, respectively, of the exemplary embodiment of the present invention, and illustrate the arrangement of temperature sensors. FIGS. 6A to 6C each correspond to FIG. 5B illustrating the comparative example employing a different arrangement of the temperature sensors.

In the first specific example illustrated in FIG. 6A, the position of the temperature sensor 131 is the same as in the comparative example illustrated in FIG. 5B. Therefore, the distance d1 in the first specific example is the same as the distance d1 in the comparative example illustrated in FIG. 5B. Accordingly, the responsiveness of the temperature sensor 131 is also the same as in the comparative example illustrated in FIG. 5B. That is, the responsiveness of the temperature sensor 131 is not improved. However, in the first specific example, the temperature measurement position 152 for the temperature sensor 132 is at 45° from the temperature measurement position 151 for the temperature sensor 131 in the peripheral direction of the heating roller 121 toward the heat source 123. Therefore, the distance d2 between the temperature measurement position 152 and the heat source 123 according to the first specific example is shorter than the distance d2 according to the comparative example illustrated in FIG. 5B. Consequently, the responsiveness in the temperature measurement with the temperature sensor 132 in the first specific example is higher than in the comparative example illustrated in FIG. 5B.

The sum of the two distances d1 and d2, i.e., d1+d2, in the first specific example is smaller than the sum d1+d2 in the comparative example illustrated in FIG. 5B. The sum d1+d2 of the two distances d1 and d2 in the first specific example is also shorter than the sum d3+d2 of corresponding distances d3 and d2 in a case where the temperature measurement position 151 for the temperature sensor 131 coincides with the temperature measurement position 152 for the temperature sensor 132, that is, a case where the temperature sensor 131 and the temperature sensor 132 are provided at the same position and in the same orientation.

In the second specific example illustrated in FIG. 6B, the position of the temperature sensor 131 is the same as in the comparative example illustrated in FIG. 5B, and the responsiveness of the temperature sensor 131 is not improved. In contrast, the temperature measurement position 152 for the other temperature sensor 132 is at 90° from the temperature measurement position 151 for the temperature sensor 131 in the peripheral direction of the heating roller 121 toward the heat source 123. Hence, the distance d2 between the temperature measurement position 152 for the temperature sensor 132 and the heat source 123 is shortest. Therefore, compared with the comparative example illustrated in FIG. 5B and even with the first specific example illustrated in FIG. 6A, the responsiveness in the temperature measurement with the temperature sensor 132 in the second specific example is improved.

As in the first specific example, the sum d1+d2 of the two distances d1 and d2 in the second specific example is shorter than in the case where the temperature sensor 131 (or 132) is provided at the same position and in the same orientation as the temperature sensor 132 (or 131), that is, the case where the two temperature measurement positions 151 and 152 coincide with each other.

In the second specific example, the heat source 122 is provided on a virtual straight line L extending from the temperature measurement position 152 and passing through the heat source 123. That is, in a projection diagram seen from the side of the temperature measurement position 152, the heat source 122 is behind the heat source 123. Therefore, compared with the case where the heat source 122 is not behind the heat source 123, the temperature sensor 132 is less susceptible to the heat source 122 and is capable of measuring the temperature with correspondingly high accuracy.

In the third specific example illustrated in FIG. 6C, the distance d2 between the temperature measurement position 152 for the temperature sensor 132 and the heat source 123 is shortest, and the distance d1 between the temperature measurement position 151 for the temperature sensor 131 and the heat source 122 is also shortest. Therefore, compared with the comparative example illustrated in FIG. 5B, the responsiveness in the temperature measurement is improved for both of the two temperature sensors 131 and 132 in the third specific example.

As in the first and second specific examples, the sum d1+d2 of the two distances d1 and d2 in the third specific example is shorter than in the case where one of the two temperature sensors 131 and 132 is provided at the same position and in the same orientation as the other, that is, the case where the two temperature measurement positions 151 and 152 coincide with each other.

In the third specific example, as in the second specific example illustrated in FIG. 6B, the heat source 122 is provided on the virtual straight line L extending from the temperature measurement position 152 and passing through the heat source 123 in the projection diagram. That is, in the third specific example, seen from the side of the temperature measurement position 152, the heat source 122 is behind the heat source 123, as in the second specific example. Therefore, compared with the case where the heat source 122 is not behind the heat source 123, the temperature sensor 132 is less susceptible to the heat source 122 and is capable of measuring the temperature with correspondingly high accuracy.

In the third specific example, the temperature measurement position 151 for the temperature sensor 131 is also on the virtual straight line L. Hence, in a projection diagram seen from the side of the temperature measurement position 151, the heat source 123 is behind the heat source 122. Therefore, compared with the case where the heat source 123 is not behind the heat source 122, the temperature sensor 131 is also less susceptible to the heat source 123 and is capable of measuring the temperature with correspondingly high accuracy.

Figure 7A:
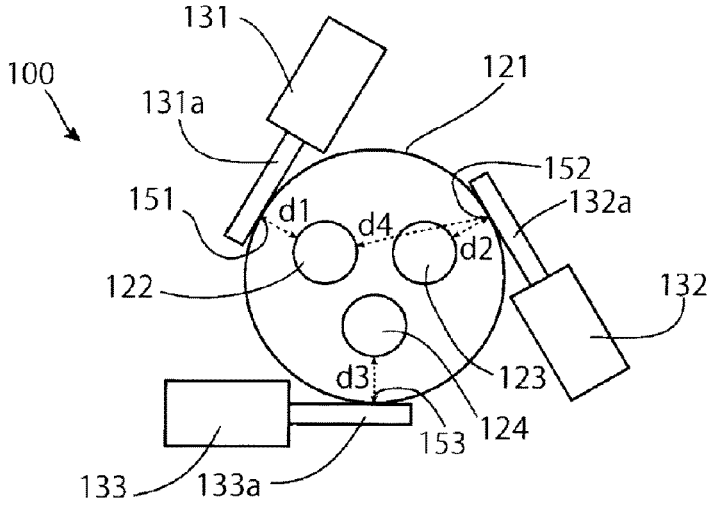
FIGS. 7A to 7C are projection diagrams of fixing devices according to other specific examples, respectively, of the exemplary embodiment of the present invention, as a continuation of FIGS. 6A to 6C, and illustrate the arrangement of temperature sensors.
Figure 7B:
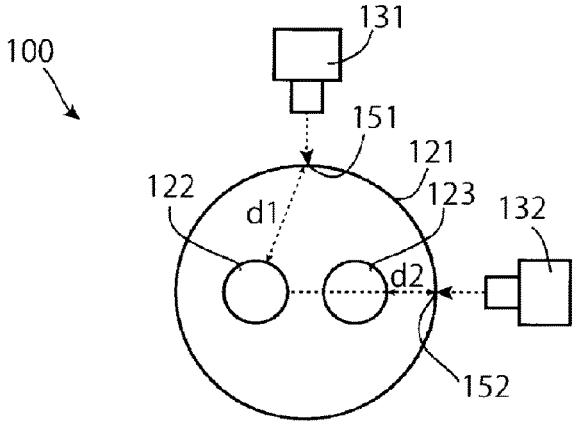
Figure 7C:
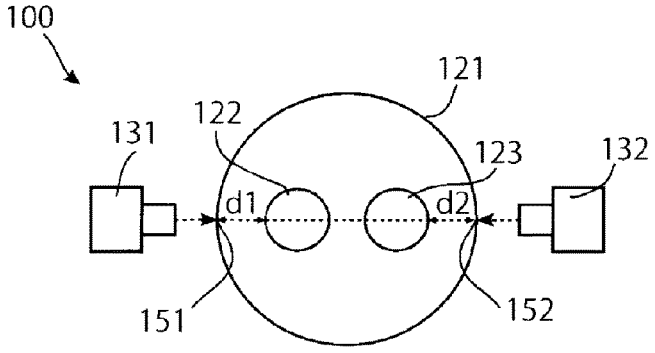

FIGS. 7A, 7B, and 7C are projection diagrams of fixing devices according to fourth, fifth, and sixth specific examples, respectively, of the exemplary embodiment of the present invention that are projected in the rotational-axis direction of respective heating rollers, as a continuation of FIGS. 6A to 6C.

In the fourth specific example illustrated in FIG. 7A, three heat sources 122, 123, and 124 are provided in the heating roller 121. The three heat sources 122, 123, and 124 are provided at different positions in the projection diagram illustrated in FIG. 7A. In the fourth specific example, the three heat sources 122, 123, and 124 are arranged at 120° with respect to one another in the peripheral direction of the heating roller 121 in the projection diagram illustrated in FIG. 7A. Furthermore, the fourth specific example employs three temperature sensors 131, 132, and 133 in correspondence with the three heat sources 122, 123, and 124. The points of contact between the heating roller 121 and detecting portions 131*a*, 132*a*, and 133*a* of the three temperature sensors 131, 132, and 133, that is, temperature measurement positions 151, 152, and 153, are at shortest distances d1, d2, and d3 from the heat sources 122, 123, and 124, respectively.

In the fourth specific example, as in the first to third specific examples illustrated in FIGS. 6A to 6C, focusing on any two of the three temperature sensors (for example, the temperature sensor 131 and the temperature sensor 132), the sum (for example, d1+d2) of the two distances (for example, the distance d1 and the distance d2) for the two temperature sensors is shorter than the sum (for example, d4+d2) in the case where one of the two temperature sensors is provided at the same position and in the same orientation as the other temperature sensor, that is, the case where the two temperature measurement positions coincide with each other (for example, the temperature measurement position 151 coincides with the temperature measurement position 152). Hence, the responsiveness of the temperature sensors in the fourth specific example is improved correspondingly.

In the fifth specific example illustrated in FIG. 7B, non-contact temperature sensors that each measure the surface temperature of the heating roller 121 from a position that is out of contact with the heating roller 121 are employed as the temperature sensors 131 and 132.

The fifth specific example is equivalent to the second specific example illustrated in FIG. 6B, except that the temperature sensors 131 and 132 are of a non-contact type. Therefore, further description of the fifth specific example is omitted.

The sixth specific example illustrated in FIG. 7C also employs non-contact temperature sensors 131 and 132, as in the fifth specific example illustrated in FIG. 7B. The sixth specific example is equivalent to the third specific example illustrated in FIG. 6C, except that the temperature sensors 131 and 132 are of a non-contact type. Therefore, further description of the sixth specific example is omitted.

Focusing on the two temperature sensors 131 and 132 in each of the fifth and sixth specific examples illustrated in FIGS. 7B and 7C or the two temperature sensors 131 and 132 among the three temperature sensors 131, 132, and 133 in the fourth specific example illustrated in FIG. 7A, one of the two, or the temperature sensor 132, is shifted from the other, or the temperature sensor 131, in the peripheral direction by the same angle and toward the same side as the temperature measurement position 152 for the one temperature sensor 132 that is shifted from the temperature measurement position 151 for the other temperature sensor 131 in the peripheral direction. In the fourth specific example illustrated in FIG. 7A, the temperature measurement position 152 is shifted from the temperature measurement position 151 by 120° in the peripheral direction. Correspondingly, the temperature sensor 132 is shifted from the temperature sensor 131 by the same angle (120°) and toward the same side in the peripheral direction. That is, if the elements included in the fixing device 100 illustrated in FIG. 7A are rotated altogether by 120° toward the opposite side in the peripheral direction, the temperature sensor 132 overlaps the position where the temperature sensor 131 has been present before being rotated (in the state illustrated in FIG. 7A). The same applies to the fifth and sixth specific examples illustrated in FIGS. 7B and 7C, except that the angle of shift in the peripheral direction is 90° and 180°, respectively.

Thus, since the positional relationship between the one temperature sensor 131 and the temperature measurement position 151 therefor and the positional relationship between the other temperature sensor 132 and the temperature measurement position 152 therefor are the same as each other, the adjustment of the orientation, sensitivity, and other factors of the temperature sensors 131 and 132 becomes easier than in a case where the two positional relationships are different from each other.

Figure 8A:
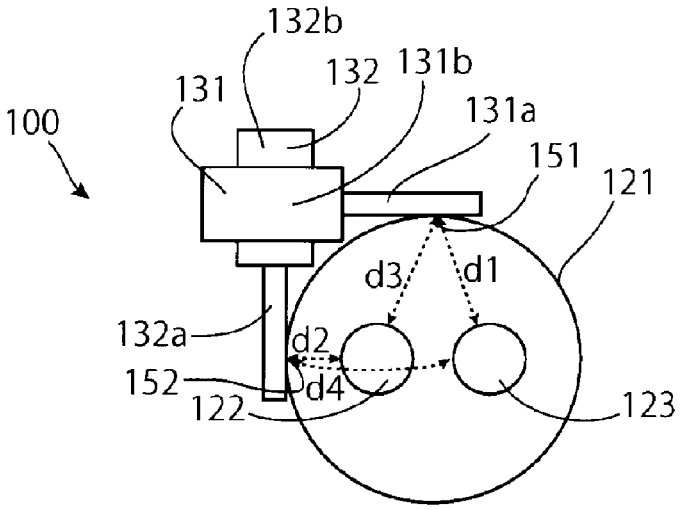
FIGS. 8A to 8B are projection diagrams of fixing devices according to yet other specific examples, respectively, of the exemplary embodiment of the present invention, as a continuation of FIGS. 6A to 7C, and illustrate the arrangement of temperature sensors.
Figure 8B:
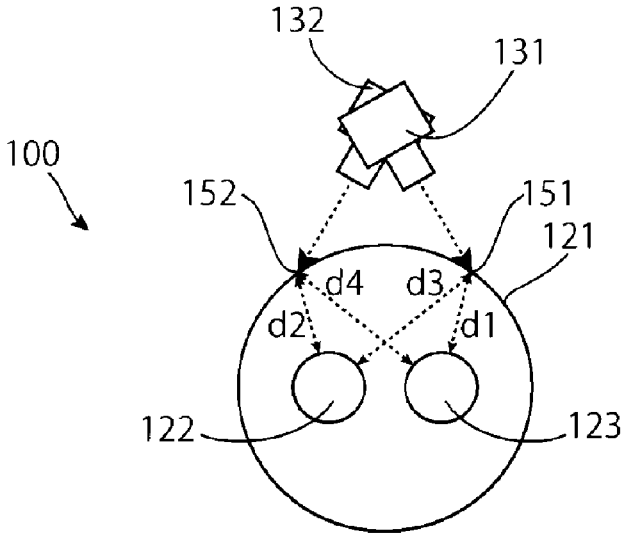

FIGS. 8A and 8B are projection diagrams of fixing devices according to seventh and eighth specific examples, respectively, of the exemplary embodiment of the present invention that are projected in the rotational-axis direction of respective heating rollers, as a continuation of FIGS. 6A to 7C.

In the seventh specific example illustrated in FIG. 8A, two temperature sensors 131 and 132 are arranged such that at least part of the supporting portion 131*b* and part of the supporting portion 132*b* thereof overlap each other in the projection diagram. However, the two temperature sensors 131 and 132 are in different orientations, and the detecting portions 131*a* and 132*a* thereof are in contact with the heating roller 121 at different positions (the temperature measurement positions 151 and 152) in the peripheral direction.

In the seventh specific example, the sum d1+d2 of the two distances d1 and d2 is shorter than the sum d1+d3 in a case where the one temperature sensor 132 is in the same orientation as the other temperature sensor 131 and the temperature measurement position 152 coincides with the temperature measurement position 151 in the peripheral direction. The sum d1+d2 is also shorter than the sum d2+d4 in a case where the temperature sensor 131 is in the same orientation as the temperature sensor 132 and the temperature measurement position 151 coincides with the temperature measurement position 152 in the peripheral direction.

In the eighth specific example illustrated in FIG. 8B, at least part of the non-contact temperature sensor 131 and part of the non-contact temperature sensor 132 overlap each other in the projection diagram. However, the two temperature sensors 131 and 132 are in different orientations, and the temperature measurement positions 151 and 152 are therefore different. In the eighth specific example, the sum d1+d2 is also shorter than the sum d1+d3 and the sum d2+d4.

In each of the seventh and eighth specific examples, seen in the longitudinal direction (the rotational-axis direction of the heating roller 121), the space occupied by relevant elements is smaller than in a case where the two temperature sensors 131 and 132 do not overlap each other in the projection diagram. Such a configuration contributes to the size reduction of the fixing device 100 and thus to the size reduction of the image forming apparatus.

Figure 9:
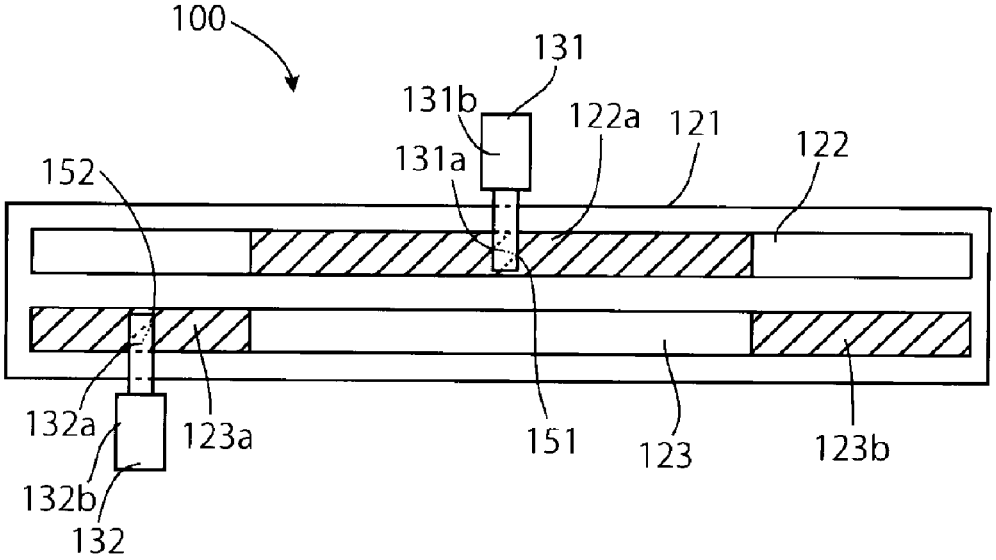
FIG. 9 is a schematic diagram illustrating the shape of the fixing device according to the exemplary embodiment that is oriented with the rotational axis thereof extending horizontally.

FIG. 9 is a schematic diagram illustrating the shape of the fixing device 100 according to the present exemplary embodiment that is oriented with the rotational axis thereof extending horizontally. In FIG. 9, the pressing roller 111 and the pressing mechanisms 140 (see FIGS. 3A and 3B) are not illustrated.

As illustrated in FIG. 9, in the fixing device 100 according to the present exemplary embodiment, the temperature measurement position 151 for the temperature sensor 131 is defined at a position on the outer peripheral surface of the heating roller 121 that faces the heating portion 122*a* defined in the central portion, in the longitudinal direction (the horizontal direction in FIG. 9), of the heat source 122. Therefore, in the exemplary embodiment illustrated in FIG. 9, the responsiveness of the temperature sensor 131 is higher than in a case where the temperature measurement position 151 does not face the heating portion 122*a*. The heating portion 122*a* and the temperature measurement position 151 are defined in the central portion in the longitudinal direction. That is, in the arrangement according to the exemplary embodiment, the temperature sensor 131 that measures the temperature of the central portion, in the longitudinal direction, of the heating roller 121 has improved responsiveness.

In the fixing device 100 according to the present exemplary embodiment illustrated in FIG. 9, the temperature measurement position 152 for the other temperature sensor 132 is defined at a position on the outer peripheral surface of the heating roller 121 that faces the heating portion 123*a*, which is one of the two heating portions 123*a* and 123*b* provided in the respective left and right end portions, in the longitudinal direction (the horizontal direction in FIG. 9), of the heating roller 121. Therefore, in the exemplary embodiment illustrated in FIG. 9, the temperature sensor 132 that measures the temperature of the end portion of the heating roller 121 has higher responsiveness than in a case where the temperature measurement position 152 faces neither of the heating portions 123*a* and 123*b*.

While an exemplary embodiment in which the present invention is applied to the printer 1 (see FIGS. 1 and 2) has been described, the present invention is not necessarily applied only to the printer 1 illustrated in FIGS. 1 and 2. The present invention may also be applied to, for example, a monochrome printer or a multi-function machine having plural functions including a function of a printer. Comprehensively speaking, the present invention is widely applicable to any fixing device including a fixing unit that has plural heat sources extending thereinside in the longitudinal direction thereof and rotates in the peripheral direction, and plural sensors that measure the surface temperature of the fixing unit, and to any image forming apparatus including the fixing device.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit that rotates in a peripheral direction and in which a plurality of heat sources each extending in a longitudinal direction are provided; and a plurality of sensors that measure a surface temperature of the fixing unit, wherein the plurality of heat sources are provided at different positions in a projection diagram in which the fixing device is projected in a rotational-axis direction of the fixing unit, wherein a first measurement position on the surface of the fixing unit that is defined for a first one of the plurality of sensors is different in the peripheral direction from a second measurement position on the surface of the fixing unit that is defined for a second one of the plurality of sensors, wherein a sum of a first distance between the first measurement position and a first one of the plurality of heat sources that is nearest to the first measurement position in the projection diagram and a second distance between the second measurement position and a second one of the plurality of heat sources that is nearest to the second measurement position in the projection diagram is smaller than a sum of the first distance and the second distance in a case where the second measurement position coincides with the first measurement position in the peripheral direction, and wherein the second heat source is provided on a virtual straight line extending from the first measurement position and passing through the first heat source in the projection diagram.

2. The fixing device according to claim 1, wherein the second measurement position is on the virtual straight line in the projection diagram.

3. The fixing device according to claim 1, wherein the first heat source heats the fixing unit by generating heat in a first heating portion included in part of the fixing unit in the longitudinal direction, and wherein the first measurement position is defined at a position, in the longitudinal direction, on the surface of the fixing unit that faces the first heating portion.

4. The fixing device according to claim 3, wherein the first heating portion is a central portion of the fixing unit excluding two end portions of the fixing unit in the longitudinal direction.

5. The fixing device according to claim 4, wherein the second heat source heats the fixing unit by generating heat in a second heating portion included in either of the two end portions excluding at least part of the central portion, and wherein the second measurement position is defined at a position, in the longitudinal direction, on the surface of the fixing unit that faces the second heating portion.

6. The fixing device according to claim 1, wherein the second sensor is provided at a position shifted from the first sensor in the peripheral direction by a same angle as the second measurement position that is shifted from the first measurement position in the peripheral direction.

7. An image forming apparatus comprising the fixing device according to claim 1, wherein a toner image is held on a recording material, and the toner image is fixed on the recording material.

8. A fixing device comprising:

a fixing unit that rotates in a peripheral direction and in which a plurality of heat sources each extending in a longitudinal direction are provided; and a plurality of sensors that measure a surface temperature of the fixing unit, wherein the plurality of heat sources are provided at different positions in a projection diagram in which the fixing device is projected in a rotational-axis direction of the fixing unit, wherein a first measurement position on the surface of the fixing unit that is defined for a first one of the plurality of sensors is different in the peripheral direction from a second measurement position on the surface of the fixing unit that is defined for a second one of the plurality of sensors, wherein a sum of a first distance between the first measurement position and a first one of the plurality of heat sources that is nearest to the first measurement position in the projection diagram and a second distance between the second measurement position and a second one of the plurality of heat sources that is nearest to the second measurement position in the projection diagram is smaller than a sum of the first distance and the second distance in a case where the second measurement position coincides with the first measurement position in the peripheral direction, and wherein, seen in the longitudinal direction, the first sensor and the second sensor are arranged such that at least part of the first sensor and part of the second sensor overlap each other.

9. The fixing device according to claim 8, wherein the first sensor and the second sensor each include a detecting portion that is in contact with the surface of the fixing unit; and a supporting portion that supports the detecting portion, and wherein, seen in the longitudinal direction, the first sensor and the second sensor are arranged such that at least part of the supporting portion of the first sensor and part of the supporting portion of the second sensor overlap each other.

10. A fixing device comprising:

fixing means that rotates in a peripheral direction and in which a plurality of heat sources each extending in a longitudinal direction are provided; and a plurality of sensors that measure a surface temperature of the fixing means, wherein the plurality of heat sources are provided at different positions in a projection diagram in which the fixing device is projected in a rotational-axis direction of the fixing means, wherein a first measurement position on the surface of the fixing means that is defined for a first one of the plurality of sensors is different in the peripheral direction from a second measurement position on the surface of the fixing means that is defined for a second one of the plurality of sensors, wherein a sum of a first distance between the first measurement position and a first one of the plurality of heat sources that is nearest to the first measurement position in the projection diagram and a second distance between the second measurement position and a second one of the plurality of heat sources that is nearest to the second measurement position in the projection diagram is smaller than a sum of the first distance and the second distance in a case where the second measurement position coincides with the first measurement position in the peripheral direction, and wherein, seen in the longitudinal direction, the first sensor and the second sensor are arranged such that at least part of the first sensor and part of the second sensor overlap each other.

* * * * *